US011280053B2

(12) United States Patent
Yamamoto et al.

(10) Patent No.: US 11,280,053 B2
(45) **Date of Patent: *Mar. 22, 2022**

(54) MAGNETIC MARKER

(71) Applicant: AICHI STEEL CORPORATION, Tokai (JP)

(72) Inventors: Michiharu Yamamoto, Tokai (JP); Tomohiko Nagao, Tokai (JP); Hitoshi Aoyama, Tokai (JP)

(73) Assignee: AICHI STEEL CORPORATION, Tokai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/972,018

(22) PCT Filed: May 21, 2019

(86) PCT No.: PCT/JP2019/020183

§ 371 (c)(1),
(2) Date: Dec. 4, 2020

(87) PCT Pub. No.: WO2019/239824

PCT Pub. Date: Dec. 19, 2019

(65) Prior Publication Data

US 2021/0230821 A1 Jul. 29, 2021

(30) Foreign Application Priority Data

Jun. 11, 2018 (JP) ..... JP2018-111405

(51) Int. Cl.
*E01F 11/00* (2006.01)
*G08G 1/042* (2006.01)

(52) U.S. Cl.
CPC ..... *E01F 11/00* (2013.01); *G08G 1/042* (2013.01)

(58) Field of Classification Search
CPC .. E01F 11/00; G05D 2201/0213; G08G 1/042
See application file for complete search history.

(56) References Cited

U.S. PATENT DOCUMENTS 1,791,997 A * 2/1931 Benton ..... E01F 13/105 246/128
1,803,292 A * 4/1931 Adler, Jr. ..... G08G 1/042 340/905

(Continued)

FOREIGN PATENT DOCUMENTS

JP 2005-202478 A 7/2005
JP 2006-195873 A 7/2006

(Continued)

OTHER PUBLICATIONS

International Search Report for corresponding Application No. PCT/JP2019/020183, dated Jul. 30, 2019.

*Primary Examiner* — Qutbuddin Ghulamali
(74) *Attorney, Agent, or Firm* — Renner, Otto, Boisselle & Sklar, LLP

(57) ABSTRACT

A magnetic marker to be laid in or on a road to achieve driving support control such as lane departure warning for warning departure of a vehicle from a lane and so forth, is a magnetic marker in which an RFID tag having an antenna for transmitting or receiving electric waves for wireless communication is retained in a magnet forming a magnetism generation source. The magnetic marker further includes a protective cover which prevents proximity of water to the antenna of the RFID tag and isolates the antenna from water. Thus, more information can be stably provided to a vehicle side.

8 Claims, 17 Drawing Sheets

(56) References Cited

U.S. PATENT DOCUMENTS

| | | | | |
|---|---|---|---|---|
| 3,609,678 | A * | 9/1971 | Fayling | G08G 1/096783 340/905 |
| 5,408,179 | A * | 4/1995 | Sampey | G01V 3/087 324/253 |
| 5,853,846 | A * | 12/1998 | Clark | B32B 5/16 428/131 |
| 6,468,678 | B1 * | 10/2002 | Dahlin | E01F 9/30 180/167 |
| 2002/0149493 | A1 * | 10/2002 | Yudate | E01F 9/30 340/693.5 |
| 2007/0252706 | A1 * | 11/2007 | Furutani | G06K 19/005 340/572.8 |
| 2009/0030605 | A1 * | 1/2009 | Breed | B60W 30/18154 701/532 |
| 2014/0354414 | A1 * | 12/2014 | Karmakar | H03H 9/642 340/10.3 |
| 2019/0098468 | A1 * | 3/2019 | Yamamoto | G01C 21/26 |
| 2019/0155305 | A1 | 5/2019 | Yamamoto | |
| 2019/0194886 | A1 | 6/2019 | Yamamoto | |

FOREIGN PATENT DOCUMENTS

| | | | |
|---|---|---|---|
| JP | 2017-162463 | A | 9/2017 |
| JP | 2017-224236 | A | 12/2017 |
| WO | 2017/187879 | A1 | 11/2017 |

* cited by examiner

[FIG. 1]
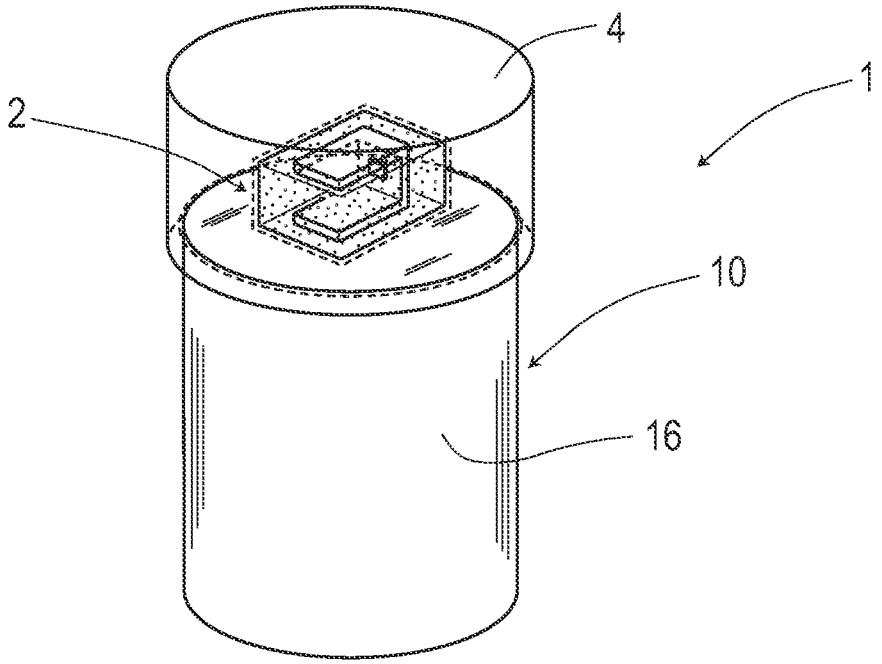

[FIG. 2]
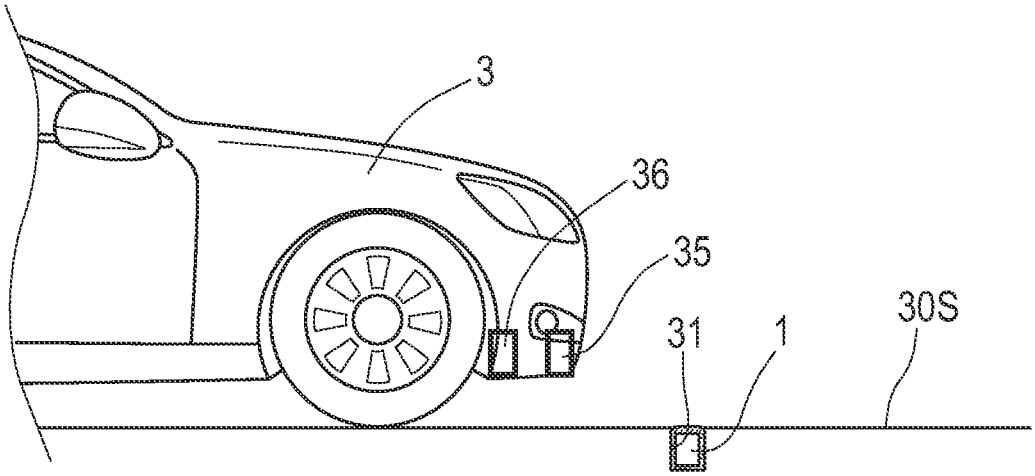

[FIG. 3]
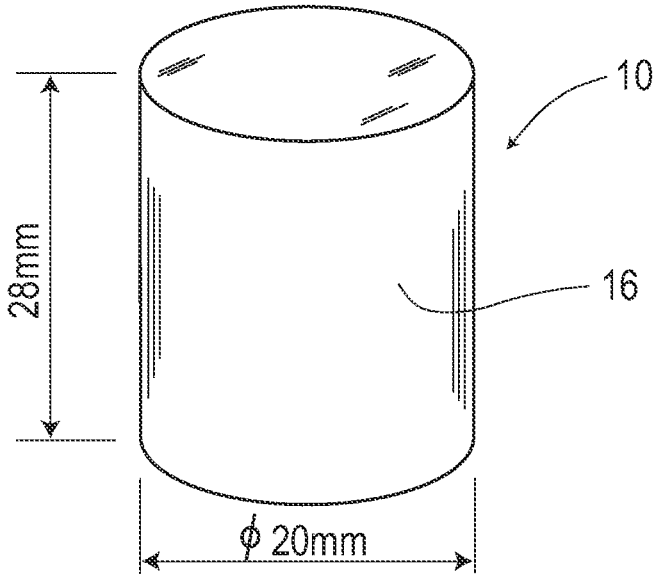

[FIG. 4]
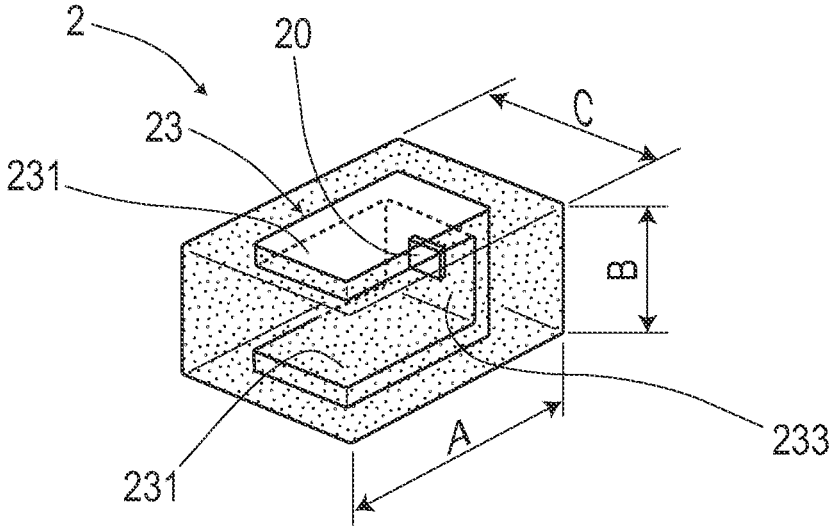

[FIG. 5]
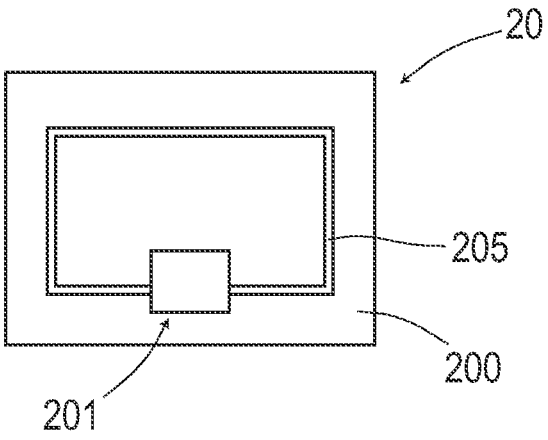

[FIG. 6]
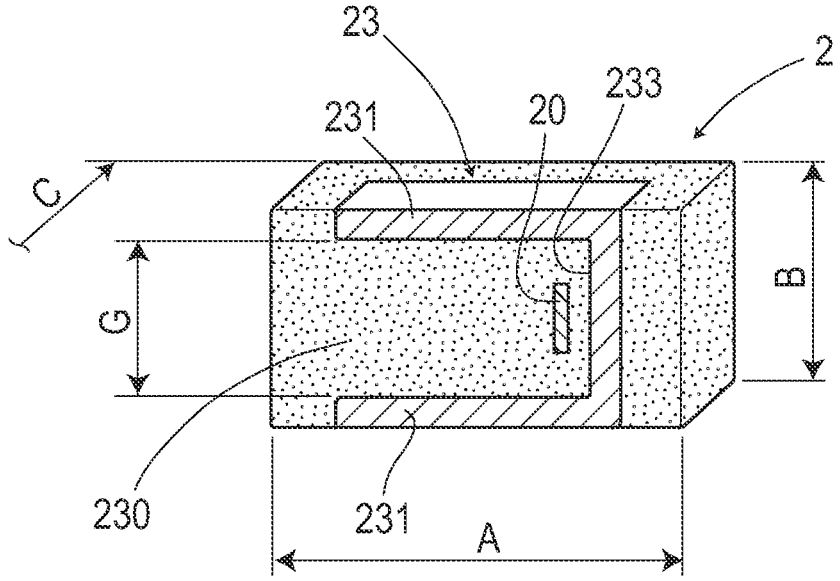

[FIG. 7]
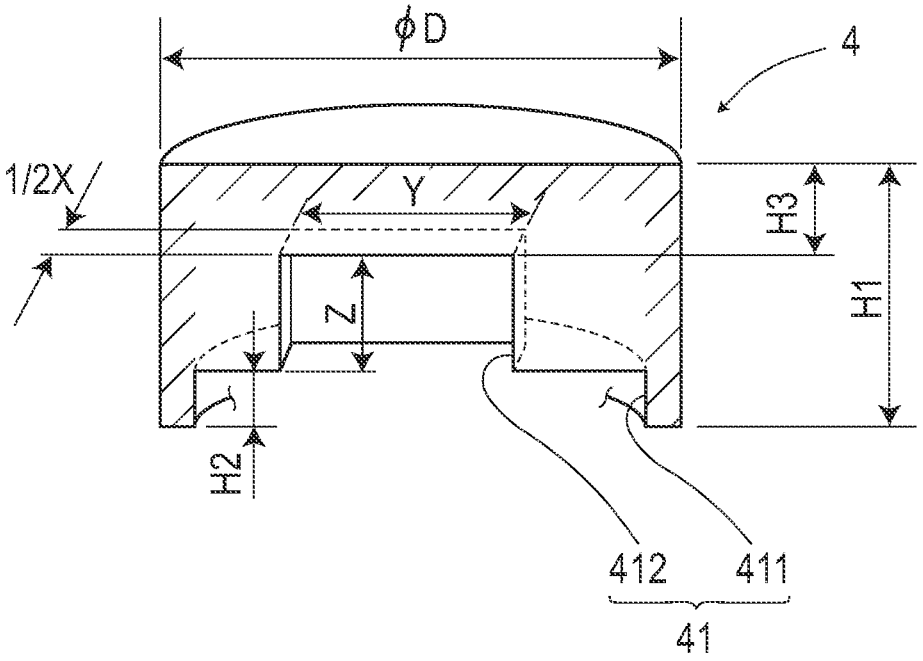

[FIG. 8]
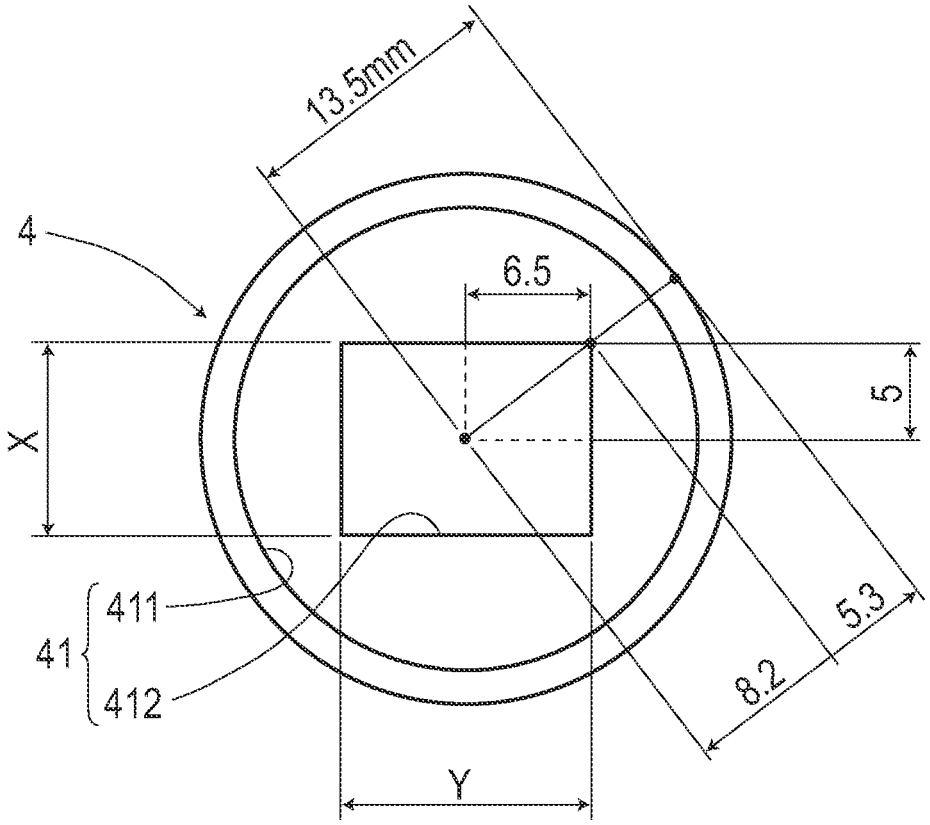

[FIG. 9]
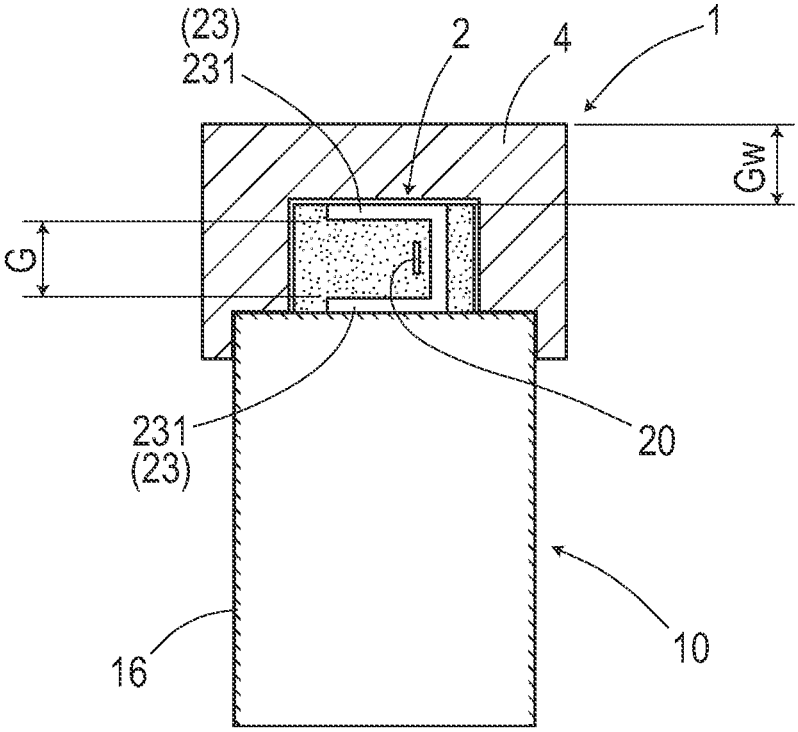

[FIG. 10]

| | | Gw (mm) | | | | | | | |
|---|---|---|---|---|---|---|---|---|---|
| | | 1 | 2 | 3 | 4 | 5 | 6 | 7 | 8 |
| G (mm) | 3 | B | B | A | A+ | A+ | A+ | A+ | A+ |
| | 4 | B | B | A- | A | A+ | A+ | A+ | A+ |
| | 5 | B | B | B | B | A | A+ | A+ | A+ |
| | 6 | B | B | B | B | A- | A | A+ | A+ |

[FIG. 11]
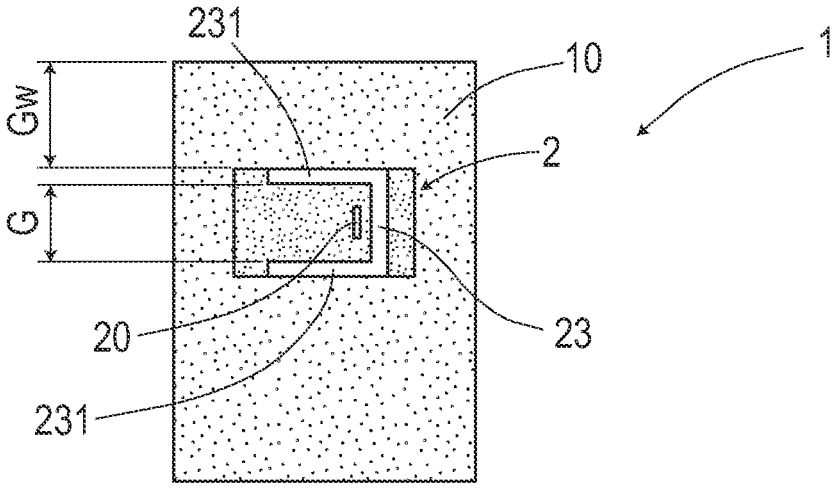

[FIG. 12]
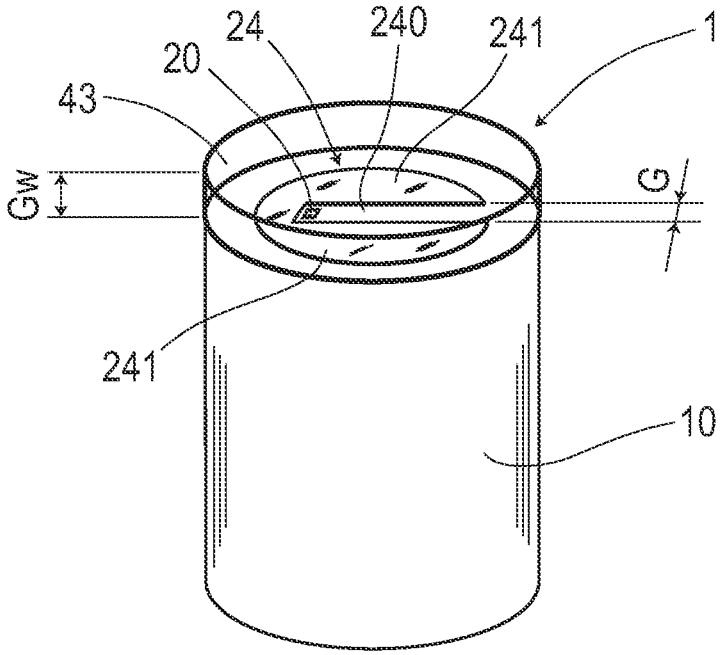

[FIG. 13]
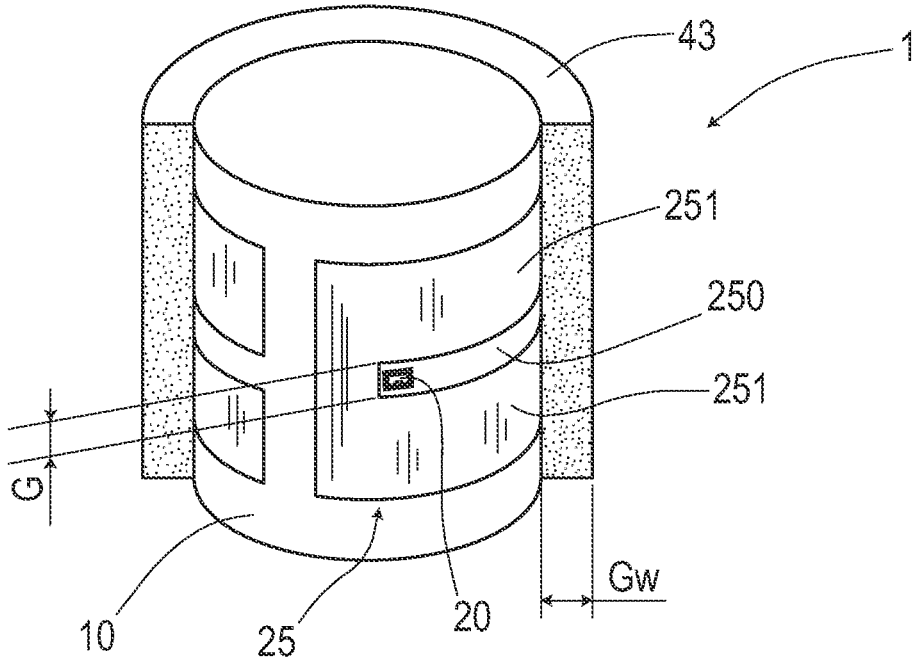

[FIG. 14]
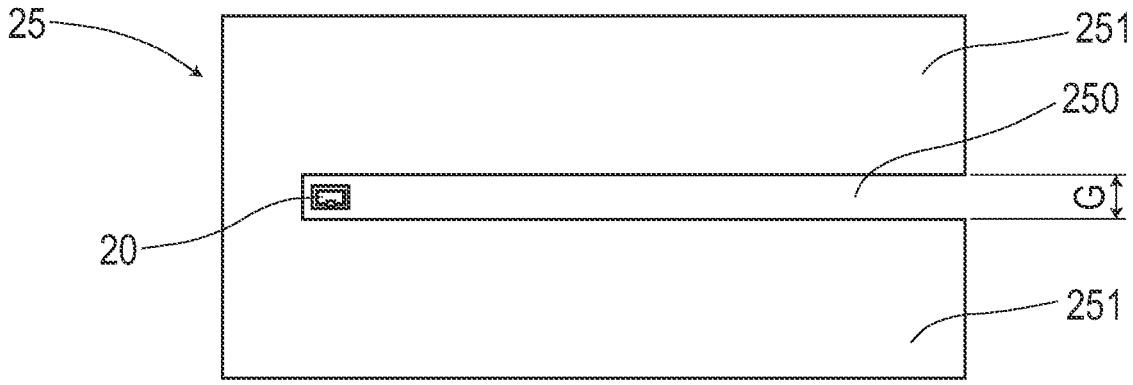

[FIG. 15]
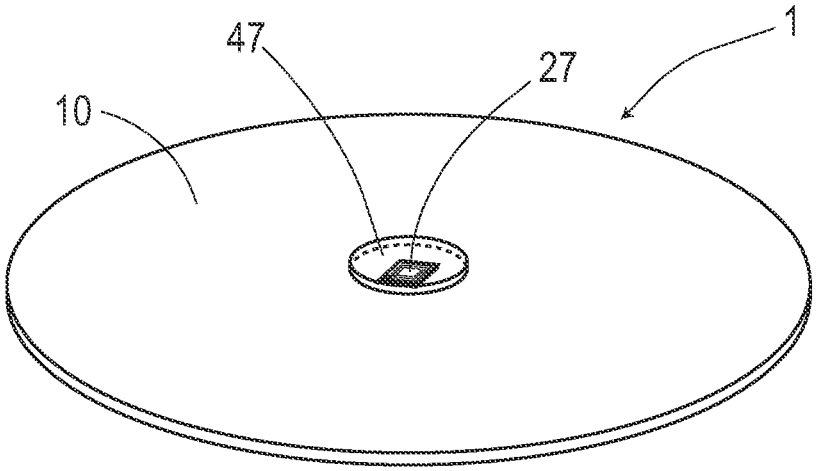

[FIG. 16]
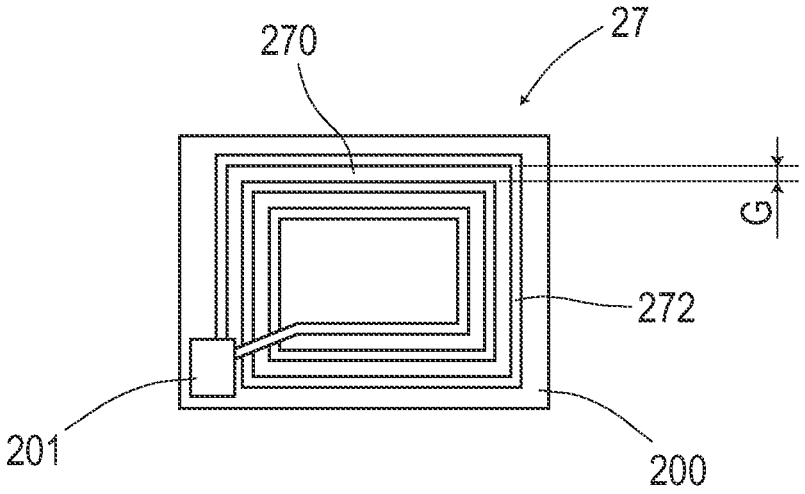

[FIG. 17]
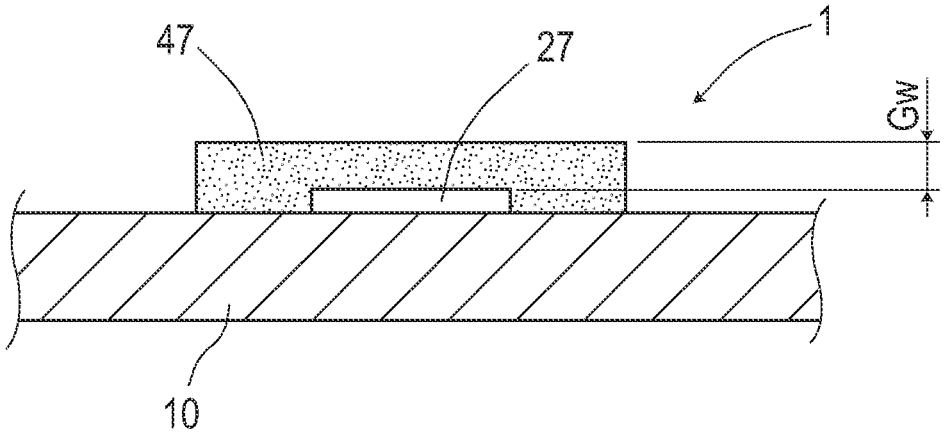

MAGNETIC MARKER

TECHNICAL FIELD

The present invention relates to magnetic markers laid in or on a road.

BACKGROUND ART

Conventionally, magnetic markers to be laid in or on a road so as to be detectable by a vehicle side have been known (for example, refer to Patent Literature 1). If the magnetic markers are used, there is a possibility of achieving automatic driving as well as various driving assists such as, for example, automatic steering control and lane departure warning using the magnetic markers laid along a lane.

However, there is a problem that information that can be acquired by detecting a magnetic marker includes information about presence or absence of the magnetic marker, a shift amount in a width direction of a vehicle with respect to the magnetic marker, whether magnetic polarity indicates the N pole or the S pole, and so forth, and the amount and types of information that can be acquired from a magnetic marker side are not sufficient. Thus, the applicant of the present application has suggested a magnetic marker including an information providing part such as an RFID tag (refer to Patent Literature 2).

CITATION LIST

Patent Literature

Patent Literature 1: Japanese Unexamined Patent Application Publication No. 2005-202478

Patent Literature 2: WO2017/187879

SUMMARY OF INVENTION

Technical Problem

With the magnetic marker including the information providing part as described above, the problem that the amount of information is not sufficient can be solved, and more information can be provided to the vehicle side by using wireless communication. However, in the event of rain or the like in which there is a possibility that a periphery of the magnetic marker may be submerged in water, stability of the wireless communication may be impaired due to influences of water exhibiting electromagnetic characteristics that attenuate electric waves. In particular, this problem may occur significantly when the UHF band is applied to the information providing part.

The present invention was made in view of the above-described conventional problem, and is to provide a magnetic marker that can stably provide more information.

Solution to Problem

The present invention resides in a magnetic marker to be laid in or on a road, including:

a wireless tag having an antenna for transmitting or receiving electric waves for wireless communication, the wireless tag being retained in a main body forming a magnetism generation source; and a protecting part which isolates the antenna of the wireless tag from water.

Advantageous Effects of Invention

The magnetic marker of the present invention includes the wireless tag. With the magnetic marker including the wireless tag, more information can be provided to a vehicle side by using the wireless communication. On the other hand, in the event of rain or the like in which there is a possibility that a periphery of the magnetic marker may be submerged in water, stability of the wireless communication may be impaired due to influences of water exhibiting electromagnetic characteristics that attenuate electric waves.

To address this, the magnetic marker of the present invention includes the protecting part which isolates the antenna from water. With the magnetic marker of the present invention including the protecting part, for example, even if water is present on the periphery of the magnetic marker in the event of rain or the like, reliability of the wireless communication can be ensured.

As described above, the magnetic marker of the present invention is a magnetic marker with excellent characteristics capable of stably providing more information.

BRIEF DESCRIPTION OF DRAWINGS

FIG. 1 is a diagram depicting a magnetic marker in a first embodiment.

FIG. 2 is a descriptive diagram exemplarily depicting a state in which a vehicle detects the magnetic marker in the first embodiment.

FIG. 3 is a diagram depicting a magnet of the magnetic marker in the first embodiment.

FIG. 4 is a perspective view of an RFID tag in the first embodiment.

FIG. 5 is a front view of a tag in the first embodiment.

FIG. 6 is a sectional view depicting an inner structure of the RFID tag in the first embodiment.

FIG. 7 is a sectional view depicting an inner structure of a protective cover in the first embodiment.

FIG. 8 is a bottom view of the protective cover in the first embodiment.

FIG. 9 is a diagram depicting a cross-sectional structure of the magnetic marker including the protective cover in the first embodiment.

FIG. 10 is a diagram exemplarily depicting results of evaluation of communication performance in the first embodiment.

FIG. 11 is a diagram depicting another magnetic marker in the first embodiment.

FIG. 12 is a perspective view depicting the magnetic marker of a first mode in a second embodiment.

FIG. 13 is a perspective view depicting the magnetic marker of a second mode in the second embodiment.

FIG. 14 is a development view of a metal foil in the second embodiment.

FIG. 15 is a diagram depicting a sheet-shaped magnetic marker in a third embodiment.

FIG. 16 is a diagram depicting the RFID tag in the third embodiment.

FIG. 17 is a diagram depicting a cross-sectional structure of the sheet-shaped magnetic marker in the third embodiment.

DESCRIPTION OF EMBODIMENTS

Modes for implementation of the present invention are specifically described by using the following embodiments.

First Embodiment

The present embodiment is an example regarding magnetic marker 1 including an RFID tag (Radio Frequency IDentification Tag, wireless tag) which provides information via wireless communication. Details of this are described by using FIG. 1 to FIG. 11.

Magnetic marker 1 is, as in FIG. and FIG. 2, a road marker arranged, for example, along a center of a lane. For example, magnetic markers 1 arranged along the center of the lane can be used for various vehicle controls, such as lane departure warning, a lane keep assist, and automatic driving. In this magnetic marker 1, RFID tag 2 in a state of being covered with protective cover 4 is retained on one end face of columnar magnet 10.

With vehicle 3 (FIG. 2) equipped with magnetic sensor unit 35 which detects magnetism and tag reader unit 36 communicable with RFID tag 2, magnetic marker 1 can be magnetically detected during travel, and tag information can be acquired via wireless communication with RFID tag 2. Examples of the tag information include information indicating an absolute position, identification information of corresponding magnetic marker 1, road information such as intersections and branch roads, and so forth.

(Magnet)

Magnet 10 (FIG. 3) forming a main body (magnetism generation source) of magnetic marker 1 is an isotropic ferrite plastic magnet or a ferrite rubber magnet, made with magnetic powder of iron oxide as a magnetic material dispersed in a polymer material (non-conductive material) as a base material. Magnet 10 with magnetic powder dispersed in the non-conductive polymer material has an electrical characteristic of low electric conductivity. Also this magnet 10 includes a magnetic characteristic of a maximum energy product (BHmax)=6.4 kJ/$m^3$.

Columnar magnet 10 having a diameter of 20 mm and a height of 28 mm has a magnetic flux density Gs of 45 mT (millitesla) at the surface of magnet 10. The magnetic flux density of 45 mT is equivalent to or less than the magnetic flux density of the surface of a magnet sheet for use as being affixed to, for example, a whiteboard at an office or the like, a refrigerator's door at home, and so forth. Magnetic marker 1 including this magnet 10 acts magnetism of approximately 8 μT or more in a range of height from 100 mm to 250 mm above the ground, which is a floor height of vehicle 3. For example, according to an MI sensor or the like with high accuracy having a magneto-impedance element, magnetism of magnetic marker 1 can be detected with high reliability.

Of outer peripheral surfaces of magnet 10, conductive layer 16 is formed on the end face as an attachment surface for RFID tag 2 and an outer peripheral side surface. Conductive layer 16 is a copper-plated layer made by metal plating and having a thickness of 0.03 mm. This conductive layer 16 is in contact with the outer peripheral surface of magnet 10. However, since magnet 10 has low electric conductivity as described above, conductive layer 16 is in a state of not being electrically in contact with the main body of magnet 10.

(RFID Tag)

RFID tag 2 (FIG. 4) is an electronic component configured to include antenna 23 made of metal (conductive material) by folding a narrow strip-shaped flat plate (omitted in the drawings) in an U shape and sheet-shaped tag 20. RFID tag 2 is formed of a block shape with three sides having dimensions A, B, and C in FIG. 4 of 12 mm, 7 mm, and 9 mm, respectively. In the present embodiment, one of surfaces defined by dimension A and dimension C serves as an attachment surface to magnet 10.

Tag 20 (FIG. 5) is an electronic component having IC (Integrated Circuit) chip 201 implemented on a surface of tag sheet 200 having a size of 2 mm×3 mm. IC chip 201, which is one example of a processing part for processing information superposed on electric waves in wireless communication, operates by electric power wirelessly supplied to RFID tag 2 and wirelessly outputs stored information as tag information. Tag 20 is preferably a wireless tag in the UHF band.

Tag sheet 200 is a sheet-shaped member cut out from a PET (PolyEthylene Terephthalate) film. On the surface of tag sheet 200, antenna 205 is formed, which is a printed pattern with conductive ink made of silver paste. Antenna 205 is formed of a ring shape with a notch, and a chip arrangement area (omitted in the drawings) for arranging IC chip 201 is formed in the notched portion. When IC chip 201 is bonded to tag sheet 200, antenna 205 is electrically connected to IC chip 201.

In tag 20, antenna 205 is in a state of being provided to electrically extend from IC chip 201. This antenna 205 has both a role as an antenna for power feeding to generate exciting current by external electromagnetic induction and a role as an antenna for communication to wirelessly transmit information.

In RFID tag 2, for example, by insert molding of injecting and curing a resin material, antenna 23 forming the U shape is retained in resin in a landscape state (refer to FIG. 4). Of the dimensions of block-shaped RFID tag 2, only dimension B (refer to FIG. 6) corresponding to the lateral width of the U shape formed by antenna 23 matches the corresponding dimension of antenna 23. The other dimensions A and C are larger than those of antenna 23. In RFID tag 2, paired flat plate parts 231 facing each other via gap 230 of U-shaped antenna 23 are exposed so as to be flush with the outer surfaces of block-shaped RFID tag 2, respectively. In RFID tag 2 of the present embodiment, paired flat plate parts 231 arranged to face each other via gap 230 are one example of any two waveguide parts included in antenna 23. In RFID tag 2 of the present embodiment, as in FIG. 6, antenna gap G, which is a distance of gap 230 where paired flat plate parts 231 face each other, is 5 mm.

In RFID tag 2, sheet-shaped tag 20 is retained in resin so as to face inner bottom surface 233 of U-shape formed by antenna 23. Between tag 20 and antenna 23, a gap is provided, and both are in a state of being not in electrical contact with each other and being electrically insulated via resin. In RFID tag 2, antenna 205 of tag 20 provided to electrically extend from IC chip 201 functions as a primary antenna, and is coupled to antenna 23 by electrostatic coupling, electromagnetic coupling, or the like in an electrically non-contact state. Antenna 23 functions as an antenna which mediates electric waves transmitted and received by antenna 205 of tag 20 and amplifies the electric waves to enhance radio field intensity.

Note that as for an arrangement position of tag 20 in RFID tag 2, tag 20 is preferably required to be positioned inside antenna 23 having a U-shaped cross section. Sheet-shaped tag 20 may be retained so as to face not bottom surface 233 of U-shape formed by antenna 23 but either one of flat plate parts 231 of antenna 23 facing each other. Furthermore, sheet-shaped tag 20 may be retained so as to be orthogonal to bottom surface 233 of U-shape and also orthogonal to flat plate parts 231 facing each other.

Furthermore, as for RFID tag 2 (refer to FIG. 6) in a state in which the gap is provided between tag 20 and antenna 23 and both are in a state of being electrically insulated via resin, antenna 205 incorporated in tag 20 and antenna 23 may be electrically in contact with each other. In this case, antenna 205 of tag 20 electrically makes contact with conductive layer 16 via antenna 23.

(Protective Cover)

Protective cover 4 of FIG. 7 is one example of a protecting part which isolates antenna 23 from water, and is attached to cover RFID tag 2 retained on the end face of magnet 10. As protective cover 4, for example, a resin-molded component made of a resin material (one example of a polymer material) such as PP (PolyPropylene) or PET can be adopted. Note that as a material for forming protective cover 4, in addition to the above, any of the following materials may be used: epoxy resin; silicone resin; silicone rubber; asphalt; a ferrite plastic magnet or a ferrite rubber magnet, which is made of the same material as that of the main body of magnet 10; the polymer material forming the base material of the ferrite plastic magnet or the ferrite rubber magnet; and so forth.

Protective cover 4 forms a columnar outer shape having a diameter D=27 mm and a height H1=17 mm. In one end face of protective cover 4, dent 41 is provided to be bored to accommodate end parts of RFID tag 2 and magnet 10. Dent 41 is formed of a two-stage structure in a depth direction from the end face. On an end face side, circular-shaped first-stage recess 411 having a depth H2=3 mm corresponding to an outer shape of magnet 10 is provided. In a bottom surface of this circular recess 411, accommodating part 412, which is a rectangular-parallelepiped-shaped second-stage recess to accommodate block-shaped RFID tag 2, is provided. Note that protective cover 4 may have the columnar outer shape having a diameter D=30 mm and a height H1=25 mm.

Protective cover 4 has a fluid-tight structure that prevents water from entering accommodating part 412 when mounted fluid-tightly onto magnet 10. This fluid-tight structure is achieved by a structure in which accommodating part 412 is open only on the bottom surface of recess 411 and an inner peripheral surface of recess 411 makes fluid-tight contact with the main body of magnet 10. At least one of a space between the end face of columnar magnet 10 and the bottom surface of the recess 411 and a space between the outer peripheral side surface of magnet 10 and the inner peripheral side surface of recess 411 is fluid-tight.

In accommodating part 412, a shape of the opening formed by dimension X and dimension Y is a rectangle with a size of 13 mm×10 mm, and depth Z from the bottom surface of circular recess 411 is 8 mm. Accommodating part 412 has inner dimensions so that all of three sides increase by 1 mm with respect to the outer dimensions of RFID tag 2 (12 mm×9 mm×7 mm). In this manner, with slightly larger size of accommodating part 412 than RFID tag 2, an error in the attachment position of RFID tag 2 with respect to magnet 10 can be absorbed. Also, thickness H3 of protective cover 4 on a bottom side of accommodating part 412 is 6 mm, which is obtained by subtracting depth H2 (3 mm) of recess 411 and depth Z (8 mm) of accommodating part 412 from height H1 (17 mm) of protective cover 4.

Note that accommodating part 412 is provided at a center of circular recess 411. Therefore, the thickness of protective cover 4 in a radial direction is minimum at each corner part of accommodating part 412. As in FIG. 8, a distance from the center of circular recess 411 to the corner part of accommodating part 412 is approximately 8.2 mm (the square root of the sum of 6.5 squared plus 5 squared, Pythagorean theorem). Thus, on an outer perimeter of accommodating part 412, a minimum thickness of protective cover 4 having a diameter of 27 mm in the radial direction is approximately 5.3 mm (27 mm/2-8.2 mm).

(Magnetic Marker)

Magnetic marker 1 is assembled by combining RFID tag 2, magnet 10, and protective cover 4 together as in FIG. 9. RFID tag 2 is attached to the end face of magnet 10 via a surface where flat plate part 231 of antenna 23 having a U-shaped cross section is exposed. Attachment of RFID tag 2 may be chemical bonding such as, for example, adhesive bonding using a conductive adhesive; physical bonding such as ultrasonic metal bonding by shaking RFID tag 2 by ultrasonic vibration for bonding; or mechanical bonding such as screwing.

Here, conductive layer 16 is formed on the end face of magnet 10 forming the attachment surface for RFID tag 2. On the other hand, in RFID tag 2, antenna 23 is exposed on the attachment surface to magnet 10. Therefore, if RFID tag 2 is bonded to the end face of magnet 10 as described above, it brings into a state that antenna 23 electrically makes contact with conductive layer 16. Conductive layer 16 of magnetic marker 1, together with antenna 23, functions as an external antenna of antenna 205 incorporated in tag 20.

In magnetic marker 1, protective cover 4 is mounted so as to cover RFID tag 2. Protective cover 4 in magnetic marker 1 accommodates an end part of magnet 10 in first-stage circular recess 411 configuring dent 41 in the two-stage structure and accommodates RFID tag 2 in second-stage accommodating part 412. Protective cover 4 is mounted so as to be closely attached to the outer peripheral surface of magnet 10 with elastic deformation of recess 411, thereby ensuring fluid tightness. Note that as a method of mounting protective cover 4, an adhesive may be used for bonding.

The thickness of protective cover 4 covering RFID tag 2 is, as described above, 6 mm in an axial direction of columnar magnet 10 corresponding to a direction of dimension B (refer to FIG. 4) of RFID tag 2 and approximately 5.3 mm or more in the radial direction of columnar magnet 10. In the case of RFID tag 2 including flat plate parts 231 as waveguide parts facing each other with antenna gap G (dimension of gap 230), a performance of antenna 23 depends on a thickness of RFID tag 2 in the direction of dimension B.

In the case of magnetic marker 1, when a periphery is submerged in water and water makes contact with an outer surface of protective cover 4, a boundary surface of water in contact with the outer surface of protective cover 4 is formed. Since this boundary surface of water faces flat plate part 231, a structure similar to an antenna structure due to a face-to-face structure of paired flat plate parts 231 is formed also between flat plate part 231 and the boundary surface of water. In this case, part of energy of electric waves acts on the face-to-face structure between flat plate part 231 and the boundary surface of water, and energy of electric waves received by the antenna structure formed by paired flat plate parts 231 attenuates. Then, energy of electric waves acting on the face-to-face structure formed by the boundary surface of water is converted to eddy current occurring in water or the like and consumed to produce energy losses.

Although description will be made in detail further below, when a gap in the face-to-face structure between flat plate part 231 and the boundary surface of water is narrower than antenna gap G (dimension of gap 230) in the face-to-face structure of paired flat plate parts 231, degradation in performance of antenna 23 tends to become significant. Here, the gap in face-to-face structure of flat plate part 231 and the boundary surface of water is a gap between flat plate part 231 and the outer surface of protective cover 4, and the distance of this gap is a distance with which antenna 23 can be isolated from water. In the following description, a distance between the outer flat plate part 231 of the paired flat plate parts 231 and the outer surface of protective cover 4 is referred to as isolation distance Gw with which flat plate parts 231 (antenna 23) can be isolated from water.

In the case of protective cover 4 of the present embodiment, depth Z (FIG. 7) of accommodating part 412 with reference to the bottom surface of circular recess 411 in contact with the end face of magnet 10 is 8 mm. Since dimension B of RFID tag 2 corresponding this depth Z is 7 mm, in magnetic marker 1 with protective cover 4 attached to magnet 10 as a cap, a gap of 1 mm exists between RFID tag 2 and protective cover 4 in the axial direction of columnar magnet 10.

In magnetic marker 1, a distance from the outer surface of RFID tag 2 formed by the surface of antenna 23 to the outer surface of protective cover 4 is 7 mm, which is obtained by adding the gap of 1 mm to the thickness of 6 mm of protective cover 4. Therefore, in the case of magnetic marker 1 of the present embodiment, isolation distance Gw that can be ensured by protective cover 4 as the protecting part is 7 mm (refer to FIG. 9).

Magnetic marker 1 assembled as described above is, for example, accommodated and buried in accommodation hole 31 provided to be bored in road surface 30S (refer to FIG. 2). In paving materials such as asphalt for use in paving road surface 30S, gravel and so forth are used as an aggregate. Thus, an innumerable number of holes are formed on road surface 30S and inside road surface 30S, and there is a high possibility that rain water and so forth may permeate via these holes. And, as a matter of course, when water permeates from road surface 30S, the periphery of magnetic marker 1 is submerged in water, falling into a situation in which water becomes in proximity to antenna 23 of RFID tag 2.

Magnetic marker 1 of the present embodiment includes protective cover 4 covering RFID tag 2. Therefore, even if the periphery of magnetic marker 1 is submerged in water, water is prevented from becoming in proximity of antenna 23, and water can be isolated from antenna 23. In magnetic marker 1 of the present embodiment, as described above, isolation distance Gw with which antenna 23 can be isolated from water is 7 mm.

Here, as for magnetic marker 1 with RFID tag 2, the inventors have conducted various tests regarding communication performance of RFID tag 2. Test items include submersion tests for measuring communication performance in a state in which magnetic marker 1 is submerged in water, and so forth. And, through submersion tests when the thickness of protective cover 4 is changed as a parameter, the inventors have found that the thickness of protective cover 4 greatly influences communication performance.

Furthermore, by analyzing or evaluating the test results of the submersion tests, the inventors have found that a strong correlation is present between the distance from the surface of flat plate part 231 of antenna 23 to the outer peripheral surface of protective cover 4, that is, isolation distance Gw from water to antenna 23, and antenna gap G, which is the distance of gap 230 of antenna 23 (refer to FIG. 10).

FIG. 10 exemplarily depicts results of evaluation of communication performance when the submersion test was performed for each combination between antenna gap G and isolation distance Gw. In these submersion tests, an error rate when wireless communication is performed by tag reader unit 36 set at a position one meter directly above submerged magnetic marker 1 is measured. Evaluations of communication performance A+, A, A−, and B in the drawing each represents the degree of the error rate in an easy-to-understand manner. A+ indicates such a degree of the error rate that tag reader unit 36 and RFID tag 2 can communicate without problems. A indicates such a degree of the error rate that communication can be performed without problems although the error rate is higher than that of A+. A− indicates such a degree of the error rate that communication can be performed to a certain extent but may not be able to be performed in accordance with changes in an external environment and so forth. B indicates such a degree of the error rate that stable communication cannot be achieved.

In the results of evaluation of communication performance in FIG. 10, it is significant that communication tends to be unstable when isolation distance Gw is smaller than antenna gap G. On the other hand, when isolation distance Gw is larger than antenna gap G, communication tends to be stable. Based on the drawing, it can be found that as isolation distance Gw, a value equal to antenna gap G or exceeding antenna gap G is preferably set.

Magnetic marker 1 of the present embodiment is designed by reflecting the results of evaluation of communication performance in FIG. 10. While antenna gap G of RFID tag 2 included in this magnetic marker 1 is 5 mm, isolation distance Gw=7 mm is ensured by protective cover 4. A combination of isolation distance=7 mm for antenna gap G=5 mm is a combination where the A+ mark can be obtained as a result of evaluation of communication performance in FIG. 10.

Magnetic marker 1 of the present embodiment including protective cover 4 as one example of the protecting part can sufficiently isolate antenna 23 from water even if the periphery is submerged in water, and high communication performance can be kept. Therefore, by utilizing this magnetic marker 1, even under a rainy environment or the like, wireless communication with vehicle 3 can be achieved with high reliability. Note that, on a surface side in contact with magnet 10 among the surfaces of RFID tag 2, magnet 10 functions as the protecting part. On this surface side, antenna 23 is isolated from water by magnet 10 itself.

While conductive layer 16 is provided directly on the outer peripheral surface of magnet 10 forming the main body in the present embodiment, the protecting part for preventing proximity of water may be provided on the outer perimeter of this conductive layer 16.

A resin layer made of a resin material may be formed on the outer perimeter of magnet 10, and a conductive layer may be provided outside that resin layer. Alternatively, the outer perimeter of magnet 10 provided with conductive layer 16 may be coated with a resin material, and RFID tag 2 may be arranged on a surface of a coated layer. In place of conductive layer 16 as a plated layer, a conductive layer by metal foil or the like may be provided.

A shape similar to that of protective cover 4 may be achieved by molding of a resin material or the like.

As in FIG. 11, RFID tag 2 may be arranged inside magnet 10 by insert molding or the like. In this case, RFID tag 2 is preferably arranged inside magnet 10 so that isolation distance Gw, which is a distance between antenna 23 (flat plate part 231) of RFID tag 2 and the outer surface (end face) of magnet 10, becomes longer than antenna gap G of RFID tag 2. When antenna gap G of RFID tag 2 is 5 mm, isolation distance Gw, which is a distance between the surface of RFID tag arranged inside and the end face of magnetic marker 1 (magnet 10), is preferably set as, for example, 6 mm. In this magnetic marker 1, magnet 10 itself functions as the protecting part which isolates antenna 23 of RFID tag 2 from water.

Furthermore, magnet 10 with magnetic powder of iron oxide dispersed in a polymer material (non-conductive material) may be formed so that antenna 23 and tag 20 which are components of RFID tag 2, are arranged inside.

Second Embodiment

The present embodiment is an example based on magnetic marker 1 of the first embodiment and in which a sheet-shaped RFID tag is adopted and an external antenna is provided. A first mode and a second mode with these details are described by using FIG. 12 to FIG. 14. Note that the RFID tag of the present embodiment is a sheet-shaped tag (reference sign 20 in FIG. 4) itself configuring the RFID tag of the first embodiment and is thus denoted as RFID tag 20 in description of the present embodiment.

(First Mode)

In magnetic marker 1 exemplarily depicted in FIG. 12, on one end face of columnar magnet 10, substantially circular metal foil 24 having a diameter of 12 mm is affixed and the sheet-shaped RFID tag 20 is retained. And, on the end face of magnet 10 retaining RFID tag 20, protective cover 43 having a thickness of 5 mm is provided. Note that magnet 10 of the present embodiment is different from the magnet of the first embodiment, and is not provided with the conductive layer on the outer peripheral surface.

Substantially circular metal foil 24 is concentrically arranged on a circular end face of magnet 10. The circular end face of magnet 10 has a diameter of 20 mm. Therefore, an outer circumferential edge part of substantially circular metal foil 24 having a diameter of 12 mm is positioned 4 mm inside to an inner peripheral side from the outer perimeter of the end face of magnet 10. Also, metal foil 24 is provided with slit-shaped gap 240 passing through a center of metal foil 24, with only one end part communicating with outside. On metal foil 24, two areas 241 facing each other via gap 240 having a width of 3 mm are formed. These two areas 241 are coupled together on the other end part side of gap 240 and are connected without being separated.

On the other end part corresponding to a depth side (bottom side) of slit-shaped gap 240, sheet-shaped RFID tag 20 with a size of 2 mm×3 mm is arranged. Metal foil 24 is coupled to an antenna (primary antenna, reference sign 205 in FIG. 5) of RFID tag 20 in an electrically noncontact state by electrostatic coupling, electromagnetic coupling, or the like, and functions as the external antenna. Two areas 241 facing each other via gap 240 form one example of waveguide parts arranged to face each other across gap 240. In RFID tag 20 using metal foil 24 as the external antenna, the width of 3 mm of gap 240 between two areas 241 is antenna gap G.

Protective cover 43 as one example of the protecting part is provided to extend from the end face of magnet 10. Protective cover 43 can be formed by, for example, using a cylinder (omitted in the drawings) longer than magnetic marker 1 in an axial direction and capable of accommodating magnetic marker 1 without a gap. Protective cover 43 exemplarily depicted in FIG. 12 can be formed by, for example, in a state in which magnetic marker 1 is accommodated in this cylinder, filling the end face side where RFID tag 20 is arranged with a rubber material, resin material, or the like and extracting magnetic marker 1 from the cylinder after the resin material or the like is cured.

The thickness of protective cover 43 is preferably set at a dimension exceeding antenna gap G=3 mm. With this, as isolation distance Gw, which is a distance from metal foil 24 which functions as the external antenna to the outer surface of protective cover 43, the dimension exceeding antenna gap G=3 mm can be ensured.

Note that in place of protective cover 43 made by resin molding or the like, a cap-type protective cover similar to that of the first embodiment may be adopted. Alternatively, the protective cover may be provided by forming a disk-shaped member from a flexible material such as silicone rubber and adhesively bonding it to the end face of magnet 10.

(Second Mode)

As in FIG. 13, metal foil 25 provided with slit-shaped gap 250 may be arranged so as to be wound around the outer peripheral side surface of magnet 10 and sheet-shaped RFID tag 20 may be arranged in that slit-shaped gap 250. Metal foil 25 is formed of a laterally-elongated, substantially-rectangular shape, as in a development view of FIG. 14, with the lateral-width dimension being shorter than the periphery length of magnet 10. Therefore, when this metal foil 25 is formed so as to be wound around magnet 10, the length of the metal foil is insufficient for an entire periphery of magnet 10, and the state is such that a gap is formed at one location in a circumferential direction.

As in the development view of FIG. 14, in laterally-elongated, substantially-rectangular-shaped metal foil 25, slit-shaped gap 250 extending in a longitudinal direction with only one end part being open to outside is formed. In this metal foil 25, two areas 251 facing each other via gap 250 having a width of 3 mm are formed. These two areas 251 are coupled together on a bottom side corresponding to the other end part of gap 250 and are connected without being separated.

On the other end part corresponding to a depth side (bottom side) of slit-shaped gap 250, sheet-shaped RFID tag 20 with a size of 2 mm×3 mm is arranged. Metal foil 25 is coupled to an antenna (primary antenna, reference sign 205 in FIG. 5) of RFID tag 20 in an electrically noncontact state by electrostatic coupling, electromagnetic coupling, or the like, and functions as the external antenna, as in the above-described first mode. Two areas 251 facing via gap 250 form one example of waveguide parts arranged to face each other across gap 250. In RFID tag 20 using metal foil 25 as the external antenna, the width of 3 mm of gap 250 between two areas 251 is antenna gap G.

Protective cover 43 (FIG. 13) as one example of the protecting part which isolates metal foil 25 functioning as the external antenna from water is a cylindrical resin-molded component. Cylindrical protective cover 43 has a thickness of, for example, 5 mm, which is a thickness exceeding antenna gap G=3 mm. With magnet 10 inserted into cylindrical protective cover 43, isolation distance Gw, which is a distance from metal foil 25 functioning as the external antenna to a surface of protective cover 43, has a dimension exceeding antenna gap G=3 mm.

Note that other configurations and operations and effects are similar to those of the first embodiment.

Third Embodiment

The present embodiment is an example based on the first embodiment, with a change to a sheet-shaped magnetic marker. Details of this are described by using FIG. 15 to FIG. 17.

Magnetic marker 1 of the present embodiment retains sheet-shaped RFID tag 27 on a surface of magnet sheet 10, as in FIG. 15. In this magnetic marker 1, protective seal 47, which is one example of the protecting part, is affixed so as to cover RFID tag 27.

Magnetic marker 1 is a marker that is formed of a flat circular shape having a diameter of 100 mm and a thickness of 1.5 mm and can be adhesively bonded to a road surface. Magnet sheet 10 forming this magnetic marker 1 is made by forming an isotropic ferrite rubber magnet having a maximum energy product (BHmax)=6.4 kJ/$m^3$ into a sheet shape.

As in FIG. 16, by adopting antenna 272 of a pattern being wound in a spiral shape, RFID tag 27 has its antenna performance enhanced. RFID tag 27 is formed of a sheet shape with a size of 3 mm×4 mm. This RFID tag 27 does not require an external antenna, and can singly communicate with a vehicle side. In RFID tag 27, gap 270 of spiral-shaped antenna 272 serves as antenna gap G. In this RFID tag 27, this antenna gap G is 0.5 mm.

Protective seal 47 is an adhesive seal made of PP and having a diameter of 7 mm and a thickness of 1 mm. Before combined with magnetic marker 1, protective seal 47 is in a state of being retained on mount paper. A surface of protective seal 47 on a mount-paper-peeled side serves as a bonding surface applied with an adhesive, and can be affixed directly to magnet sheet 10.

In the case of magnetic marker 1 of the present embodiment, as in FIG. 17, the dimension of 1 mm, which is the thickness of protective seal 47, serves as isolation distance Gw. Since isolation distance Gw exceeds antenna gap G=0.5 mm, even if water is attached or the like to the surface of protective seal 47, communication performance of RFID tag 27 is not impaired. Note that as for a back surface side of magnetic marker 1, with the thickness of magnet sheet 10 of 1.5 mm itself, isolation distance Gw equal to or more than 1.5 mm is ensured. In this case, as for the back surface side of magnetic marker 1, magnet sheet 10 itself functions as the protecting part which isolates RFID tag 27 from water.

In place of protective seal 47 of the present embodiment, a mold layer made of a resin material may be provided on a surface side of RFID tag 27 as one example of the protecting part. A formation area of this mold layer may be an entire surface of magnetic marker 1, but can be any area covering RFID tag 27 and may be part of a surface of magnetic marker 1.

Furthermore, the sheet-shaped RFID tag (reference sign 20 in FIG. 12) in the first mode of the second embodiment and the metal foil (reference sign 24 of the same) provided with slit-shaped gap 240 may be arranged on the surface of magnet sheet 10. Here, if the gap of the metal foil serving as antenna gap G is on the order of 3 mm, the protecting part is preferably formed by laminating a protective seal or a protective layer made by resin coating or the like having a thickness on the order of, for example, 4 mm, on the surface of magnet sheet 10. Note that since the thickness of magnet sheet 10 is 1.5 mm, it is required to provide a protective sheet, mold layer, or the like functioning as the protecting part which isolates the antenna from water also on the back surface (surface on a side where the RFID tag is not arranged) of magnet sheet 10.

Note that other configurations and operations and effects are similar to those of the first embodiment.

In the foregoing, specific examples of the present invention are described in detail as in the embodiments, these specific examples merely disclose examples of technology included in the scope of the claims. Needless to say, the scope of the claims should not be restrictively construed based on the configuration, numerical values, and so forth of the specific examples. The claims include techniques acquired by variously modifying, changing, or combining as appropriate the above-described specific examples by using known techniques, knowledge of a person skilled in the art, and so forth.

REFERENCE SIGNS LIST

1 magnetic marker
10 magnet (main body)
16 conductive layer
2 RFID tag (wireless tag)
20 tag (electronic component)
201 IC chip (processing part)
205 antenna (primary antenna)
23 antenna
230 gap
231 flat plate part (waveguide part)
3 vehicle
35 magnetic sensor unit
36 tag reader unit
30S road surface
31 accommodation hole
4 protective cover (protecting part)
412 accommodating part

The invention claimed is:

1. A magnetic marker to be laid in or on a road, comprising:

a wireless tag having an antenna for transmitting or receiving electric waves for wireless communication, the wireless tag being retained in a main body forming a magnetism generation source; and a protecting part which isolates the antenna of the wireless tag from water, wherein the antenna includes waveguide parts made of a conductive material and a gap which is formed between any two of the waveguide parts arranged so as to be opposed to each other, and the protecting part is configured so that a distance for isolating the antenna from water is longer than a distance of the gap.

2. The magnetic marker according to claim 1, wherein the wireless tag has an electrical component including a processing part for processing information superposed on the electric waves and a primary antenna provided to extend electrically from the processing part, and the electrical component is arranged in the gap.

3. The magnetic marker according to claim 2, wherein the protecting part has an accommodating part which accommodates the wireless tag, and has a structure of being fluid-tightly combined with the main body to prevent permeation of water into the accommodating part.

4. The magnetic marker according to claim 3, wherein the protecting part is formed by using a polymer material.

5. The magnetic marker according to claim 2, wherein the protecting part is formed by using a polymer material.

6. The magnetic marker according to claim 1, wherein the protecting part has an accommodating part which accommodates the wireless tag, and has a structure of being fluid-tightly combined with the main body to prevent permeation of water into the accommodating part.

7. The magnetic marker according to claim 6, wherein the protecting part is formed by using a polymer material.

8. The magnetic marker according to claim 1, wherein the protecting part is formed by using a polymer material.

* * * * *